US011268288B2

(12) United States Patent
Curtis

(10) Patent No.: US 11,268,288 B2
(45) Date of Patent: Mar. 8, 2022

(54) TRIPLE LATCHING HORIZONTAL SCAFFOLD MEMBER WITH THREE TRIGGERS

(71) Applicant: Deltak Manufacturing, Inc., Walker, LA (US)

(72) Inventor: Johnny Curtis, Denham Springs, LA (US)

(73) Assignee: DELTAK MANUFACTURING, INC., Walker, LA (US)

( * ) Notice: Subject to any disclaimer, the term of this patent is extended or adjusted under 35 U.S.C. 154(b) by 237 days.

(21) Appl. No.: 16/380,399

(22) Filed: Apr. 10, 2019

(65) Prior Publication Data

US 2019/0330864 A1 Oct. 31, 2019

Related U.S. Application Data

(63) Continuation of application No. 62/655,337, filed on Apr. 10, 2018.

(51) Int. Cl.
*E04G 7/32* (2006.01)
*E04G 7/34* (2006.01)
*E04G 5/00* (2006.01)

(52) U.S. Cl.
CPC ..... *E04G 7/32* (2013.01); *E04G 5/001* (2013.01); *E04G 7/34* (2013.01)

(58) Field of Classification Search
CPC .. E04G 7/32; E04G 7/34; E04G 7/307; E04G 5/001
See application file for complete search history.

(56) References Cited

U.S. PATENT DOCUMENTS 2,561,938 A * 7/1951 Meng ..... E04G 7/304 403/49
4,369,859 A * 1/1983 Smits ..... E04G 7/308 182/186.8
4,445,307 A * 5/1984 Puccinelli ..... E04G 7/308 52/638
5,028,164 A * 7/1991 Williams ..... F16B 7/22 403/246
5,078,532 A * 1/1992 Williams ..... E04G 7/308 403/246
5,217,314 A * 6/1993 Perruelle ..... E04G 7/32 403/49
5,961,240 A * 10/1999 Bobrovniczky ..... E04G 7/32 403/49

(Continued)

*Primary Examiner* — Alvin C Chin-Shue
*Assistant Examiner* — Shiref M Mekhaeil
(74) *Attorney, Agent, or Firm* — Intellectual Property Consulting, LLC; Bernard F. Meroney

(57) ABSTRACT

A horizontal scaffold member having a primary end connector and a secondary end connector. Each end connector is configured to couple to a cup or rosette on a vertical scaffold member. Each end connector includes a wedge assembly having a handle and a wedge, movable with respect to the connector to a latched and unlatched position. The primary wedge assembly has a primary and tertiary handles, with the tertiary handles connected to the secondary wedge assembly by a cable, and configured so that moving the primary and tertiary handles simultaneously to an unlatched position also moves the secondary wedge assembly to an unlatched position.

14 Claims, 14 Drawing Sheets

VIEW SHOWING PRIMARY TRIGGER OPERATION

(56) References Cited

U.S. PATENT DOCUMENTS 6,027,276 A * 2/2000 Schworer ..... E04G 7/307 403/49
6,354,646 B1 * 3/2002 McManus ..... B60P 3/34 296/26.01
6,572,170 B2 * 6/2003 McManus ..... B60P 3/34 296/26.13
6,669,246 B2 * 12/2003 Cowper ..... E05B 15/10 292/194
6,916,190 B2 * 7/2005 Joist ..... H05K 7/1409 361/732
7,017,710 B2 * 3/2006 Booysen ..... E04G 1/14 182/151
7,048,093 B2 * 5/2006 Wallther ..... E04G 7/307 182/186.7
7,971,686 B1 * 7/2011 Hayman ..... E04G 7/306 182/186.8
8,206,052 B1 * 6/2012 Hayman ..... E04G 5/061 403/49
8,881,869 B2 11/2014 Thacker
8,905,292 B1 * 12/2014 Hayman ..... E04G 7/06 228/178
9,303,417 B2 4/2016 Hayman
2004/0163889 A1 * 8/2004 Wallther ..... E04G 5/147 182/113
2009/0052980 A1 * 2/2009 Williams ..... E04G 7/307 403/33
2012/0186910 A1 * 7/2012 Thacker ..... E04G 7/307 182/151
2013/0126270 A1 * 5/2013 Darby ..... E04G 7/304 182/113
2014/0020982 A1 * 1/2014 Hayman ..... E04G 7/302 182/223
2014/0255086 A1 * 9/2014 Wallther ..... E04G 7/307 403/205
2014/0299413 A1 * 10/2014 Hayman ..... E04G 7/32 182/186.8
2018/0044929 A1 * 2/2018 Hayman ..... E04G 1/152
2018/0274249 A1 * 9/2018 Hayman ..... E04G 7/308

* cited by examiner

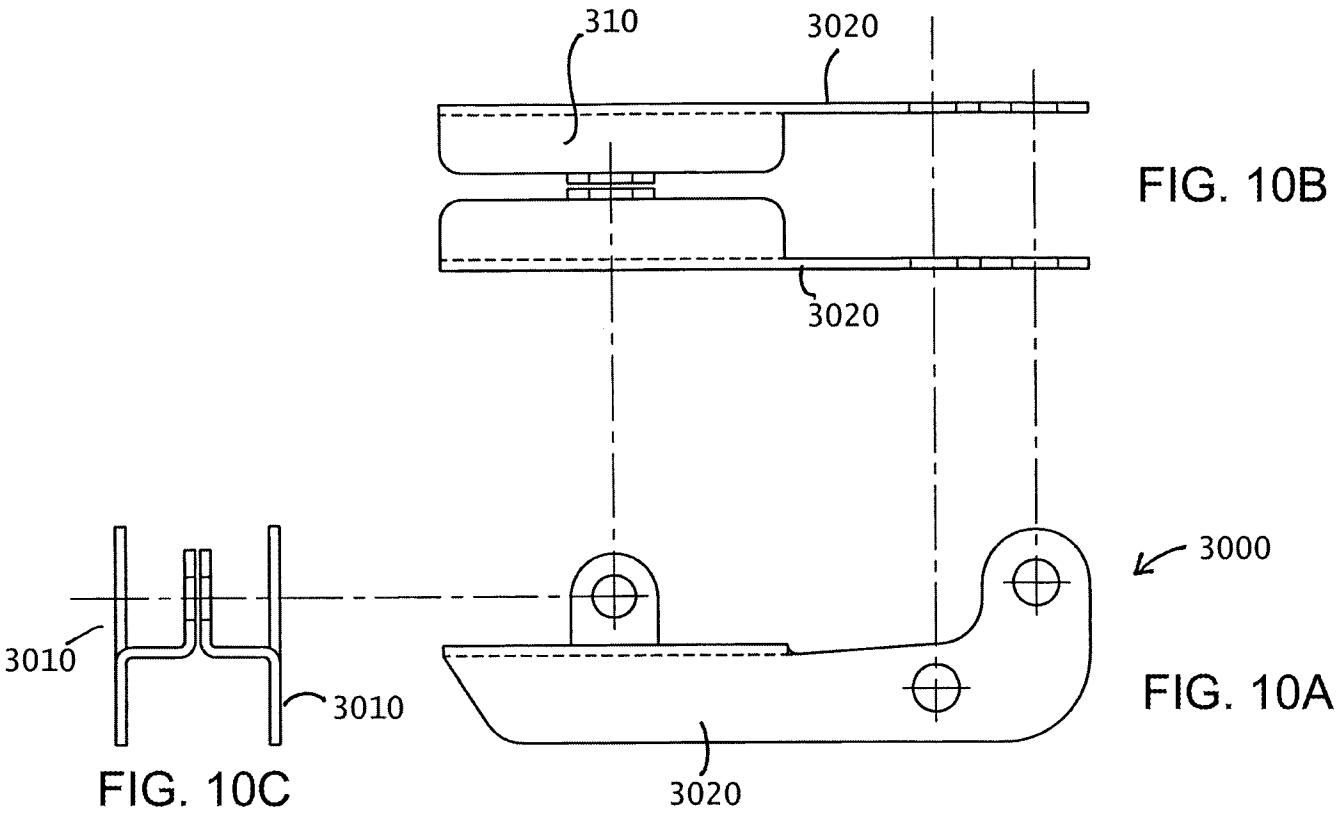
THIRD TRIGGER

VIEW OF HORIZONTAL BAR ASSEMBLY

VIEW SHOWING PRIMARY TRIGGER OPERATION

VIEW SHOWING THRID TRIGGER OPERATION

VIEW SHOWING SECONDARY TRIGGER OPERATION

TRIPLE LATCHING HORIZONTAL SCAFFOLD MEMBER WITH THREE TRIGGERS

CROSS REFERENCE TO RELATED APPLICATION(S)

This application claims priority to U.S. Provisional Application Ser. No. 62/655,337 filed on Apr. 10, 2018, which is incorporated by reference herein in its entirety.

FIELD OF THE INVENTION

This invention relates to modular scaffolding systems that are erected as impermanent structures to support platforms, and in particular to improve horizontal scaffold members used in these modular scaffold systems. Scaffolding is used, inter alfa, in the industrial, commercial, petro-chemical, power source, general industry and residential construction markets.

BACKGROUND

In 2008, the Bureau of Labor Statistics' Census of Fatal Occupational Injuries (CFOI) reported 88 fatalities and many more non-fatal injuries occurred in the year 2007 related to the use of scaffolds. Twenty-seven percent (27%) of the fatalities, and many of the injuries, involved falls from over 25 feet high during the installation of welded frame scaffolds. Safety officials recommend that scaffolding falls be pre-empted through the use of sequential erection techniques. This involves installing guardrails and standards at regular distances along the scaffold such that the exposed platform edge is not greater than a bay length between intervals. The use of safety harnesses or belts tethered to guardrails during the erection process is also a recommended safety practice. However, the use of safety harnesses to deter fall injuries during scaffold erection is quite limited due to the components used in conventional scaffolds. The nature and design of conventional scaffold components, as described herein, disadvantageously do not allow the effective use of safety harnesses during the erection process.

Tube and coupler scaffolds are so-named because they are built from tubing connected by coupling devices. Due to their strength, they are frequently used where heavy loads need to be carried, or where multiple platforms must reach several stories high. Components of scaffolds include vertical standards having coupling rings or rosettes, horizontal components such as ledgers and guardrails coupled to the coupling rings or rosettes, footings, decks/platforms and diagonal braces. Their versatility, which enables them to be assembled in multiple directions in a variety of settings, also makes them difficult to build correctly.

Conventional scaffolding systems have various components. FIG. 1 illustrates a supported scaffold 100 consisting of one or more platforms supported by rigid support members such as poles, tubes, beams, brackets, posts, frames and the like. More specifically, the supported scaffold 100 includes the following components: a deck/platform 101, horizontal members or ledgers 102, and vertical members or standards 103. Additional components may include diagonal braces to increase the stiffness and rigidity of the scaffold 100.

FIG. 2 is an illustration of a vertical standard 103. Vertical standards are typically cylindrical tubes 200 comprised of hot-dip galvanized steel or aluminum. A collar with an expanded or reduced diameter or a spigot at either or both ends of the vertical standard facilitates the joining of vertical standards from end to end. Rosettes 201 are positioned and then welded or otherwise attached along the tubes providing connections for horizontal members and diagonal braces. The vertical standard can have from one to 8 or more rosettes placed along the tubing using a predetermined spacing between rosettes, for example, about every 20 inches.

FIG. 3 illustrates a conventional horizontal member or ledger 102. A ledger is a horizontal member that serves as both a guardrail and bracing element. The ledger 102 is comprised of tubing 300, heads 301 and wedges 302. Ledgers 102 are available in different lengths, depending on the scaffolding bay length, deck type and load. It is the conventional manner in which these ledgers are coupled to vertical standards that contribute to scaffolding falls as further described herein. Once the tubing on a level is installed, decks or platforms 101 made of, e.g., hot-dip galvanized steel, aluminum, wood or an aluminum frame with plywood board are installed to allow workers to traverse the scaffold 100 and install the guardrails (e.g., ledgers 102).

Referring now to FIG. 4, wedge 302 is shown being hammered into the slot or gap of head 301 at the end of a ledger 102 so as to couple it to the rosette 201 of the vertical standard 200. This must be done by a worker first at the proximate end of the ledger 102 and then at the distal end of the ledger 102. However, as the proximate end of the ledger 102 is being coupled to the vertical standard using the wedge 302, the distal end of the ledger 102 is free and uncoupled, that is, until the worker can traverse the platform to the distal end of the ledger 102 and hammer in a wedge 302 at the distal end. During this time, the distal end of the ledger 102 remains uncoupled from the vertical standard. Hence, if the installer is harnessed to the ledger 102 and the scaffold tilts toward the uncoupled, distal end, the installer may tumble down the platform and the safety harness will exit the uncoupled end of the ledger, providing no measure of safety to the installer.

Referring to FIG. 5, an embodiment of a prior art, cup-type latching connector is depicted. The latching connector shown in FIG. 5 is disclosed in U.S. Pat. No. 4,445,307, which is hereby incorporated by reference (this particular cup-type latching connector is referred to herein as the "Safway™ System" scaffold). The Safway™ System scaffold features an end connector positioned on the end of a horizontal member, where the end connector has a lip or hook section that is designed to engage or rest on a corresponding vertical connector cup or annular ring positioned on a vertical scaffold member. As shown in FIG. 5, the horizontal scaffold member 1001 comprises an end connector 1000 having two, vertically spaced hook sections 1003. The hook sections 1003 are adapted to couple with two vertically spaced upstanding cup members 1102 located on the vertical scaffold member 1100. Each cup member 1102 has a surrounding annular lip 1103 to which the hook members 1003 of the end connector 1000 engage. To latch the end connector 1000 into engagement with the vertical scaffold member 1100, a wedge 1005 is driven (generally by a hammer) into position below—or on the underside of—the lower cup member 1102, thereby wedging the lower cup member 1102 against the lower hook section 1003 of the end connector 1000. As used herein, the term "latch" or "latching" refers to the action of securing a horizontal member to a vertical member, where the action of latching resists dislodgement of the horizontal member from the vertical member from an upwardly directed force.

Referring now to FIG. 6, an embodiment of another prior art, cup-type latching connector is depicted. The latching connector shown in FIG. 6 is disclosed in U.S. Pat. Nos. 5,078,532 and 5,028,164 and in U.S. application Ser. No. 12/489,166, all of which are hereby incorporated by reference in their entireties (these particular cup-type latching connectors referred to herein as the "Excel™ System" scaffold). As shown in FIG. 6, the Excel™ System scaffold features a horizontal scaffold member 2001 having an end connector 2000 positioned thereon. The end connector 2000 has two vertically spaced hooked sections 2003 and a pivoting member or latch 2005. Meanwhile, the vertical scaffold member 2100 has two vertically spaced, upstanding cup members 2102. The latch 2005 has a distal end extending away from the body of the horizontal scaffold member 2001, with the distal end being shaped to engage the bottom surface of the upper cup 2102. In operation, each cup member 2102 has a terminating edge or lip section 2103 that is engaged by the respective upper and lower hook sections 2003 of the end connector 2000. The latch 2005 will then be pivoted into position below the top cup member, engaging the bottom surface of the upper cup 2102. Hence, when latched, the cup 2102 is trapped between the upper hook section 2003 and the distal end of the latch 2005. The latch 2005 pivots on a pivot pin, and can be spring loaded to bias the latch into a locking or actuated position. The latch is operated by trigger or handle 2004. Single cup embodiments are also possible, such as shown in U.S. Pat. No. 7,048,093 (hereby incorporated by reference).

Duel trigger connectors also have been developed to increase the safety of prior art scaffold systems. Examples include those shown and described in U.S. Pat. Nos. 8,881,869 and 9,303,417, both of which are incorporated by reference. These devices are designed to allow a single installer to insert and lock pivoting wedges at both ends of the horizontal member, and to release both ends substantially simultaneously if using the primary trigger, or to only release one end if using the secondary trigger. The two triggers are coupled by a cable, in a configuration where (1) pulling on the primary trigger releases the associated latch member and pulls the cable taunt, thus pulling and disengaging the secondary trigger and releasing its associated latch member, and (2) pulling on the secondary trigger releases the associated latch member but loosens the cable, thus leaving the primary trigger undisturbed and cable loosens the cable, thus leaving the primary trigger undisturbed and the associated latch member engaged. However, the primary latch may be disengaged inadvertently, an undesired result.

Referring now to FIG. 7, an embodiment of a prior art, dual-trigger latching connector is depicted. A horizontal member 600 extends between, and is coupled to, first and second vertical members 800. Each vertical member 800 has two cups 801. Each cup 801 has an upwardly raised annular lip portion 802 (generally an annular raised lip with an interior surrounding depression), and an underside 809 opposite the lip portion. The horizontal scaffold member 600 has a primary wedge head 601*p* defining a primary end connector 490, and a secondary wedge head 601*s* defining a secondary end connector 390 (where the "p" represents primary and the "s" represents secondary—in most instances only a single reference number, e.g. "601" will be used herein as the two components are substantially similar in the embodiments shown, and where clarity is required, the "p" and "s" designations will be utilized). In one embodiment, the wedge heads 601*p*, 601*s* shown are crimped hollow tubes coupled to the opposing ends of the horizontal member 600, with the interior of the horizontal member 600 communicating with the interior of the wedge heads 601. Each wedge head 601 has a hook portion 602 adapted to engage the lip section 802 of the cups 800. Contained in each wedge head 601 is a wedge head assembly 610, generally comprising a trigger portion 611 (sometimes referred to as a handle), and a wedge portion 612 connected to or integral with the trigger portion 611. In the embodiment depicted, the trigger and wedge portions are integrally formed and moveable within the interior of the wedge head (e.g., pivotable or slidable). Wedge head 601 has a front opening 690 facing the vertical member through which the wedge portion 612 can extend, and a rear opening 680 through which the trigger portion 611 can extend. Each wedge assembly is biased so that the wedge portion 612 is positioned in a closed or latched or locked position by using a biasing means, such as a spring 620. When in a latched position, the hook portion 602 of the wedge head 601 will be positioned adjacent or proximate to the underside 809 of the cup 801, thereby coupling the wedge head 601 to the cup 801 in a fashion to resist removal of the wedge head by an upward force. The wedge portion 612 of the wedge head assembly 610, when latched, may or may not make contact with the underside of the cup 801. It is not necessary that the wedge be in tight engagement with the underside of the cup, or even touch the cup underside. In some embodiments, it is preferred that the connection be loose, as the connection functions to trap the cup 801 between the wedge head's wedge portion 612 and the wedge head's hook engagement portion 602. The wedge head assembly 610 is considered "open" or "unlatched" or "unlocked' when the wedge 612 is positioned away or distal from the underside of a cup 801, (in relationship to the unlatched position, by rotating the wedge inwardly to the wedge assembly) so that when an upward lifting force is applied to a wedge head 601, the wedge head 601 is detachable or separable from the cup or rosette (as the wedge portion 612 is now not in a blocking position adjacent the underside of the cup).

Still referring to FIG. 7, a biasing means, such as a coil spring, is utilized to bias the wedge head assembly 610 into a latched position. The spring 620 has two ends, 620A and 620B, and a pivot point C. End 620A bears against a bottom plate 640 on wedge head 601, while end 620B bears against handle 611. Each end of the horizontal member 600 can be connected to a vertical member 800 by "snapping" the horizontal wedge head assembly 610 into place on the cup 801 of the vertical member 800. In this action, the horizontal member 600 is positioned with the top hook portion 602 clearing the raised lip 802 of the cup 801 (the bottom hook portion will also be positioned slightly above the raised lip of the lower cup). As the wedge head 601 is moved toward the vertical member 800, the wedge portion 612 will contact the side of the cup 801 and be moved to the open or unlaced position, as the spring 620 compresses. Once the hook portion 602 on the wedge head 601 is positioned directly above the raised lip 802, the wedge head 601 can be lowered until the lip sections 802 of the upper and lower cups contacts the respective upper and lower hook engagement portions 602. At this point, the wedge portion 612 will pivot forward by spring 620 until a segment of the wedge portion 612 is positioned below the cup 801, thereby latching the horizontal member 600 to the respective vertical member 800. Also, each wedge head 601 may be manually coupled to a vertical by an operator manually depressing handle 611, and then coupling the wedge head 601 to the cups 801, and then releasing handle 611.

A cable 700 (rope, chain or other flexible connector, but generally not substantially stretchable lengthwise, with a preferred embodiment being a ⅛ inch wire rope) runs through the hollow interior of the horizontal member 600. One end of cable 700 enters the interior of the primary wedge head 601*p*, and slides over a member 90*p*, such as a pin, pulley or other member, which may be rotatable in the wedge head interior. The cable 700 then extends downwardly and is attached to or is connected to the wedge assembly at the handle 611*p*. The other end of the cable 700 enters the interior of the secondary wedge head 601*s* (or secondary end connector 390), and slides over member 90*s* and then is connected to or attached to the wedge assembly at wedge 612. The members 90*a* and 90B may be dispensed with, but they are preferred to keep the cable 700 from binding in the respective wedge head 601. As shown, a first end of the cable 700 is connected to the trigger portion 611*p* in the primary wedge head 601*p*; while the second end of the cable 700 is connected to the wedge portion 612*s* in the secondary wedge head 601*s*. As a result, as the trigger portion 611*p* in the primary end connector 490 is depressed and pivoted downwardly (thereby unlatching the wedge portion 612*p* head in the primary connector), the cable 700 follows the trigger portion 611*p* downwardly. As a result, the wedge portion 612*s* in the secondary connector 390 is also pivoted or pulled away from the corresponding vertical member 800, and the connected trigger portion 611*s* compresses the respective spring 620*s*, thereby pivoting the secondary wedge head assembly 610*s*, against the spring bias, to the unlatched position. In this fashion, a single operator may thereby unlatch both wedge heads by the operation of only the primary trigger portion 611*p*. Operation of the primary trigger or handle on the primary end connector exerts a force on the secondary end connector to detach the secondary end connector from the second vertical member simultaneously with the detachment of the primary end connector from the first vertical member. When actuated, the primary trigger transmits force through a cable tension cable. As the cable is drawn downward in the primary connector, the other end of the cable is drawn toward the primary end connector by the tension in the cable. As the wedge is connected to the cable, the wedge is thus drawn to the unlatched position. Contra wise, as the secondary latch is dawn downward to unlatch the secondary connector, the cable's tension is lessened on the primary connector, and hence no forced is exerted to counterbalance the tension of the spring in the primary end connector. However, if the operator operates the secondary trigger portion 611*s* on the secondary end connector 390 to open or unlatch the secondary wedge portion 612*s* by depressing the secondary trigger portion 611*s* and pivoting the handle downwardly, such action will not open or unlatch the wedge portion 612*p* on the primary end connector 490. This occurs due to the different attachment points of the cable 700 to the primary and secondary wedge assemblies 610. The act of operating the secondary trigger portion 611*s* will not result in the spring 620*p* in the primary wedge head 610 being compressed as there is no force exerted on the primary spring in response to operation of the secondary trigger portion 611*s* in the secondary connector 390. As the secondary trigger portion 611*s* is drawn downward to unlatch the secondary connector 390, the cable's tension is lessened on the primary connector 490, and hence no forced is exerted to counterbalance the tension of the spring in the primary end connector. Preferably, the two trigger portions 611*p* and 611*s* are shaped differently (not shown) so that an operator may easily distinguish the primary end connector from the secondary end connector. An alternative embodiment of a prior art, dual-trigger latching connector is shown in FIG. 8.

Referring now to FIG. 12, another prior art, dual-trigger latching connector is depicted. The latching connector shown in FIG. 12 is disclosed in U.S. Pat. No. 9,303,417, which is hereby incorporated by reference in its entirety. As disclosed therein, a cable 1101 is coupled to first and second linkage assemblies. A first end 1101B of the cable 1101 is coupled to a first handle 1103 of the first linkage assembly, and a second end 1101A of the cable 1101 is coupled to a second handle 1104 of the second linkage assembly via the pulley 1102. The first wedge head or end connector 1105 serves as a housing around portions of the first handle 1103, and the second wedge head or end connector 1106 serves as a housing around portions of the second handle 1104. As later used, the first end or wedge head 1105 and parts corresponds to the secondary end connector and the second end or wedge head 1106 and parts corresponds to the primary end connector. In operation, teeth 1103E and 1104E couple with openings or apertures in rosettes located on opposing vertical scaffold members, thereby supporting the horizontal member 1100 between the two opposing vertical scaffold members. Wedge portions of the handles, 1103B and 1104B can pivot between a latched position and an unlatched position. Springs 1110 and 1111 bias handles to the latched position, where the wedge ends 1103B and 1104B are positioned adjacent and below the rosette (when installed). In this configuration, when the horizontal member 1107 is coupled to two opposing vertical scaffold members, each tooth engages openings in the rosettes, with each tooth extending through the respective opening. One end of the respective wedge assemblies 1103B and 1104B are positioned below the respective rosette (such as near the tooth), thereby locking or trapping the horizontal member to the coupled rosette (e.g. an uplifting force on the horizontal will not disengage the horizontal from the coupled rosette). To unlatch a coupled wedge assembly (e.g. 1104B or 1103B), the respective wedge handle is pivoted downward or away from the horizontal member 1107, thereby compressing the respective biasing spring, and thus pivoting the respective wedge assembly (1104B or 1103B) inwardly, and away from the respective annular ring and tooth (either 1104E or 1103E), thereby allowing the respective end connector be lifted and disengaged from the rosette.

An inspection of the foregoing prior art, dual-trigger connectors shows that: (1) pulling on the primary trigger releases the associated latch member and pulls the cable taunt, thus pulling and disengaging the secondary trigger and releasing its associated latch member; and (2) pulling on the secondary trigger releases the associated latch member but loosens the cable, thus leaving the primary trigger undisturbed and the associated latch member engaged. Consequently, these prior art devices are designed to allow a single installer to release both ends of a horizontal scaffold member substantially simultaneously if using the primary trigger, or to only release one end if using the secondary trigger. However, with each of these prior art devices, the primary latch may be disengaged inadvertently, which is an undesired result.

SUMMARY

The invention disclosed herein is generally directed to a scaffold system having a horizontal scaffold member featuring primary, secondary, and tertiary release triggers which collectively allow a user to simultaneously connect and disconnect the ends of the horizontal member to a vertical member of the scaffold system while also preventing inadvertent disconnection of the horizontal member.

A scaffold system exemplifying the principles of the present invention can comprise a horizontal scaffold member having a primary end connector and a secondary end connector. Each end connector is configured to couple to an annular member—such as a cup or rosette—on a vertical scaffold member. Each end connector includes a wedge assembly having a trigger (e.g., a handle) and a wedge movable between a latched and unlatched position. The primary end connector includes two triggers, a first or primary trigger that is connected to—and actuates—the primary wedge head, and a tertiary trigger or handle that is not connected to the primary wedge head, but is connected, such as by cable, to the secondary handle and wedge head. The primary handle may be actuated separately from the tertiary handle, or may be actuated in conjunction with the tertiary handle. The design is an improvement over prior art designs using the primary handle to disconnect both ends simultaneously. The improved design provides a disconnect of the original primary trigger from the cable, and therefore allows a user to operate the primary trigger only for connecting or disconnecting he primary end from the scaffold vertical. The ability to disconnect both the primary and secondary ends remains by operation of the tertiary or third trigger, in combination with the primary trigger. The secondary end of the horizontal remains independently disconnectable, independent from the cable system, by operation of the secondary trigger or handle. This improvement prevents inadvertent actuation of the secondary trigger, and release of the second end, when operating the primary trigger. This improvement gives the user a choice to operate/actuate the secondary trigger when needed from the primary end by engaging the tertiary trigger while operating the primary trigger, or to just release the primary end by actuating only the primary trigger. Preferably, the tertiary trigger will be colored in a contrasting color to help the user identify the third trigger, and further his or her understanding of the use of this system and the triggers functions.

In further embodiments, components of the scaffold system of the present invention may include at least one horizontal member comprising a horizontal tube having a primary end connector and a secondary end connector attached at opposing ends of the tube. Each end connector (also sometimes referred to herein as a "wedge head") may include: i) an upper engagement portion that is designed to engage the top portion of an annular ring on a vertical scaffold member; and ii) a wedge portion that is designed to releasably engage the bottom portion of the annular ring, thereby securing the horizontal member to the vertical member when the end connector is positioned adjacent to the vertical member's annular ring(s). Preferably, each vertical member has at least one annular ring—such as cup or rosette—affixed thereto. More preferably, each vertical member has a plurality of annular rings in coaxial alignment thereon. In embodiments utilizing a cup, the cup has an upper side and an underside, with the upper side of the cup preferably having an upstanding edge or lip engaged by the upper engagement portion of the end connector. In certain embodiments, the upper engagement portion of the end connector may take the form of a hook, a projecting finger, a tooth or cutout located on the upper portion of the end connector. In preferred embodiments, each end connector has upper and lower engagement portions formed in the sidewalls of the end connector, with the upper engagement portion adapted to engage an upper annular ring of the vertical member and the lower engagement portion adapted to engage a lower annular ring of the vertical member. However, the invention is not limited to embodiments having two or more engagement sections, and can be utilized on scaffold systems where the end connectors are connectable to a single annular ring (such as a single cup or rosette).

In yet further embodiments, the vertical and/or horizontal members are hollow tubes constructed of metal, preferably galvanized metal of about ⅛ inch thickness. The end connectors each can be a crimped metal tube having an interior section, with suitable openings to accommodate the wedge assembly. The end connectors may be attached at substantially right angles to the long axis of the horizontal tube, or the end connectors may compromise two substantially parallel sidewalls (suitably joined together for rigidity) and having an interior space there between, and also joined to the horizontal tube at substantially right angles to the long axis of the horizontal tube.

DESCRIPTION OF THE DRAWINGS

A more complete understanding of the invention may be obtained by reference to the following Detailed Description, when taken in conjunction with the accompanying Drawings, wherein:

FIG. 10A is a side view of one embodiment of a tertiary trigger.

FIG. 10B is a top view of one embodiment of a tertiary trigger.

FIG. 10C is an end view of one embodiment of a tertiary trigger.

DETAILED DESCRIPTION

Figure 1:
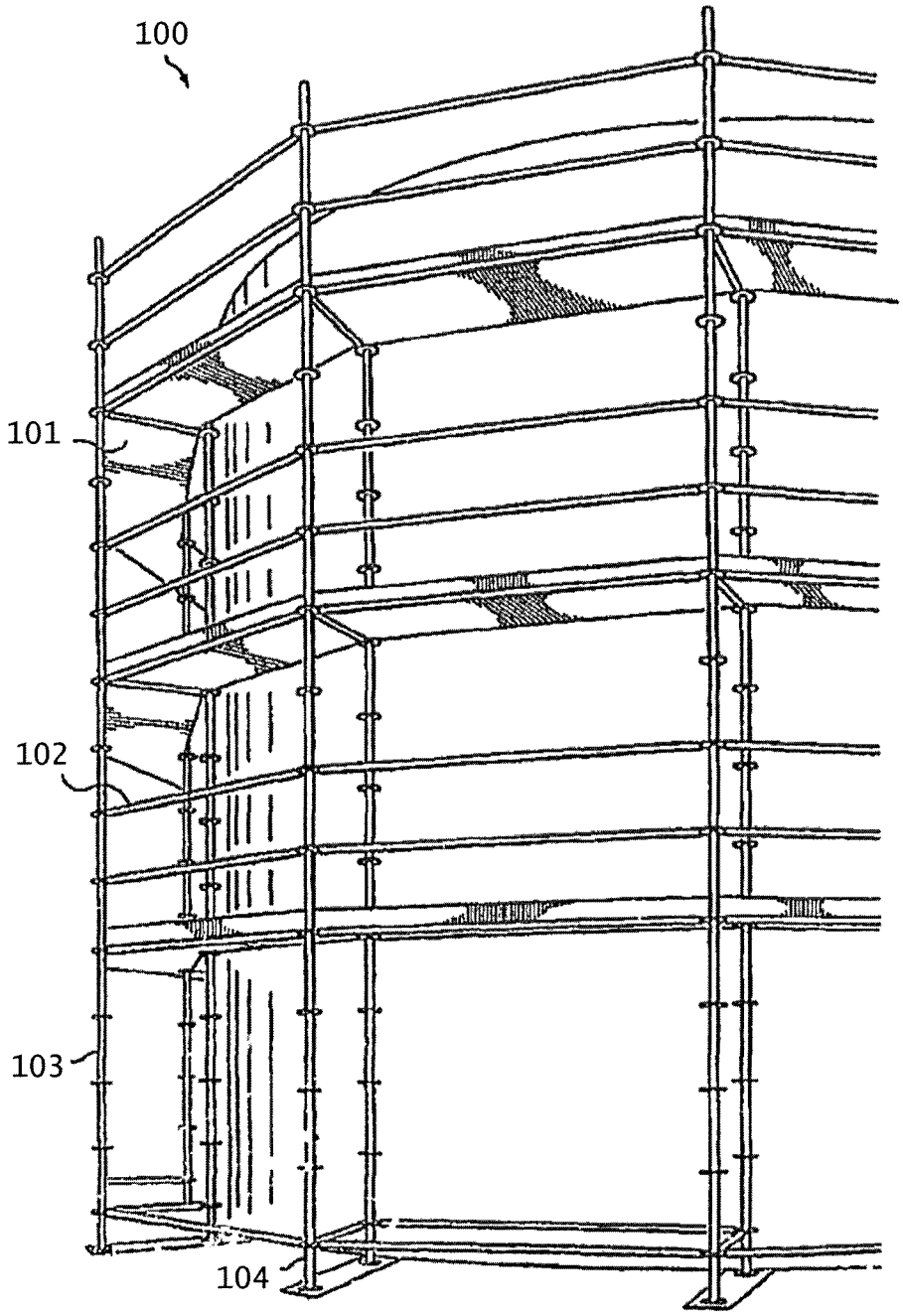
FIG. 1 illustrates a scaffold structure.
Figure 2:
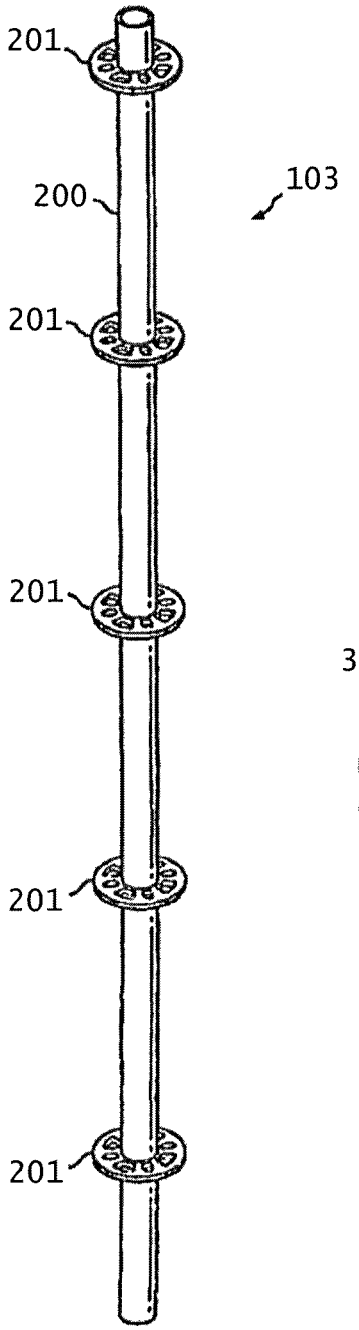
FIG. 2 illustrates a prior art vertical standard or vertical member utilized in the construction of a scaffold system.
Figure 3:
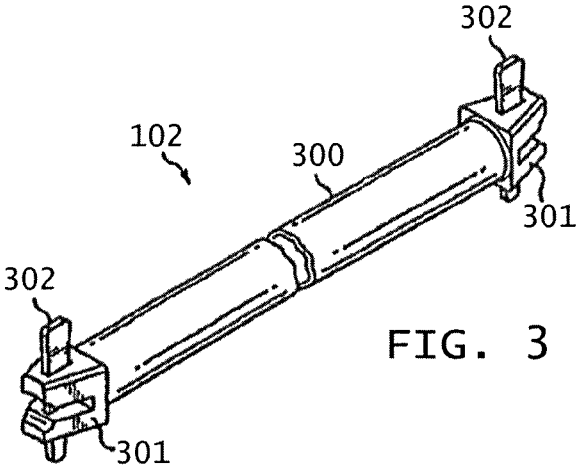
FIG. 3 Prior Art
FIG. 3 illustrates a conventional ledger or horizontal member utilized in the construction of a scaffold system.
Figure 4:
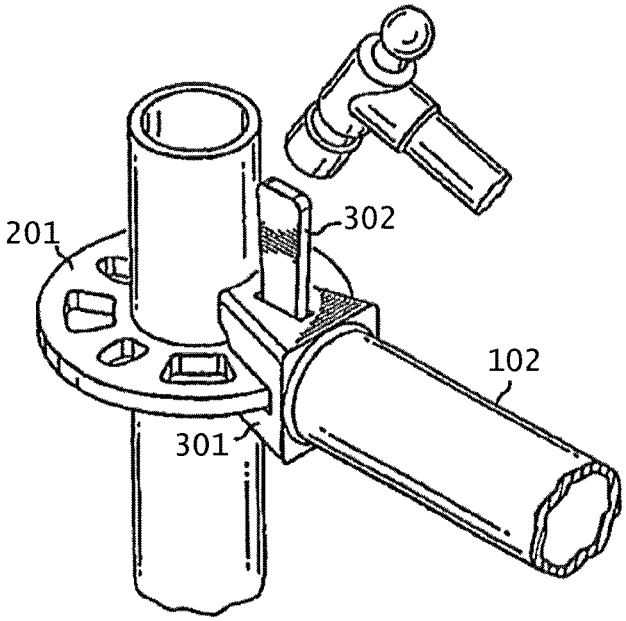
FIG. 4 Prior Art
FIG. 4 illustrates the installation of an unsecured wedge into a conventional ledger head.
Figure 5:
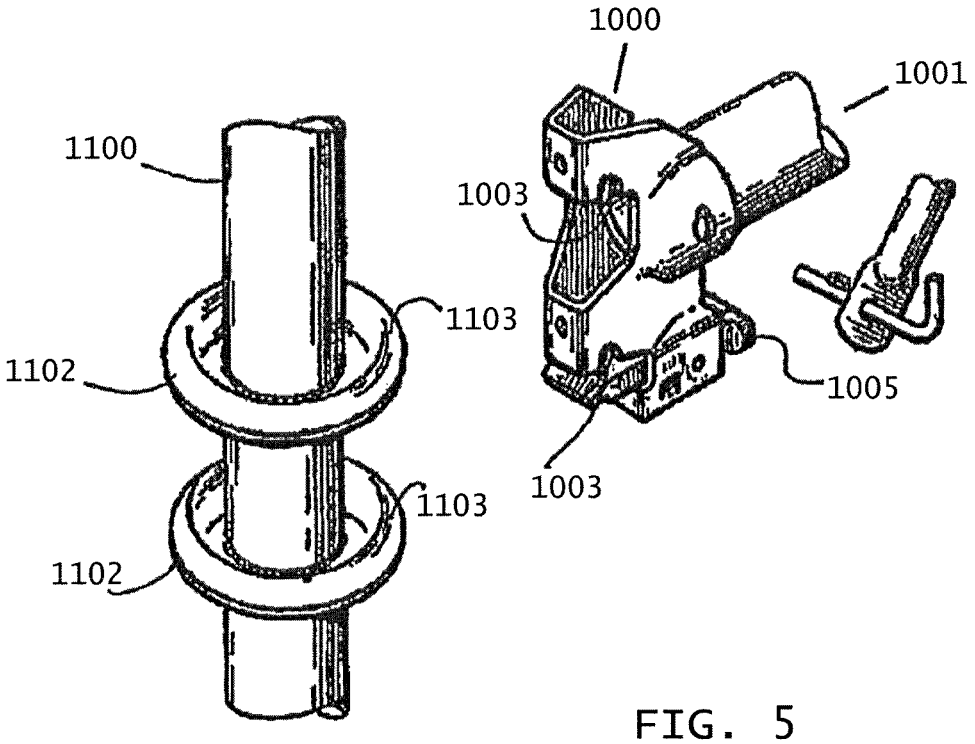
FIG. 5 Prior Art
FIG. 5 is a perspective view of a prior art Safway-type end connector.
Figure 6:
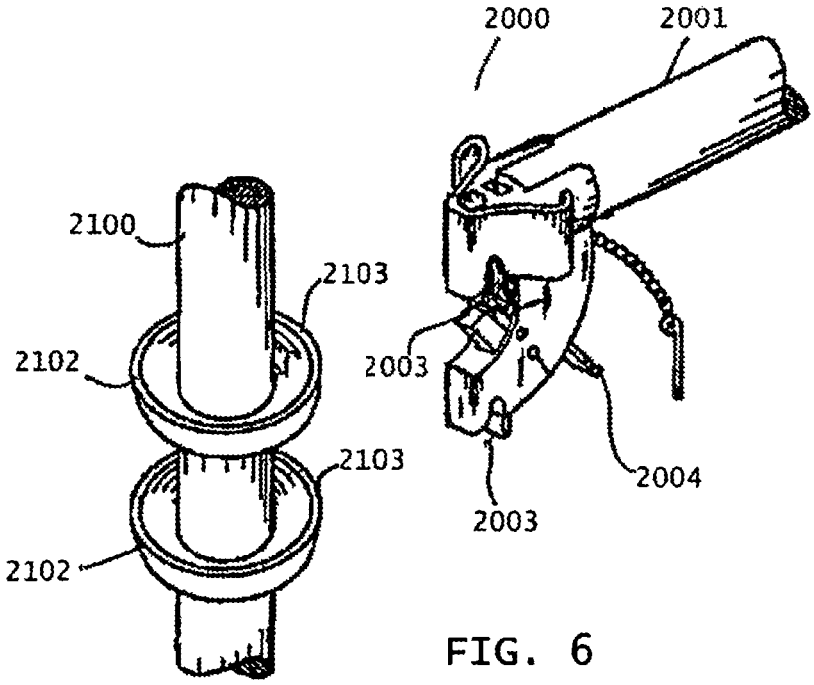
FIG. 6 Prior Art
FIG. 6 is a perspective view of a prior art Excel-type end connector.
Figure 7:
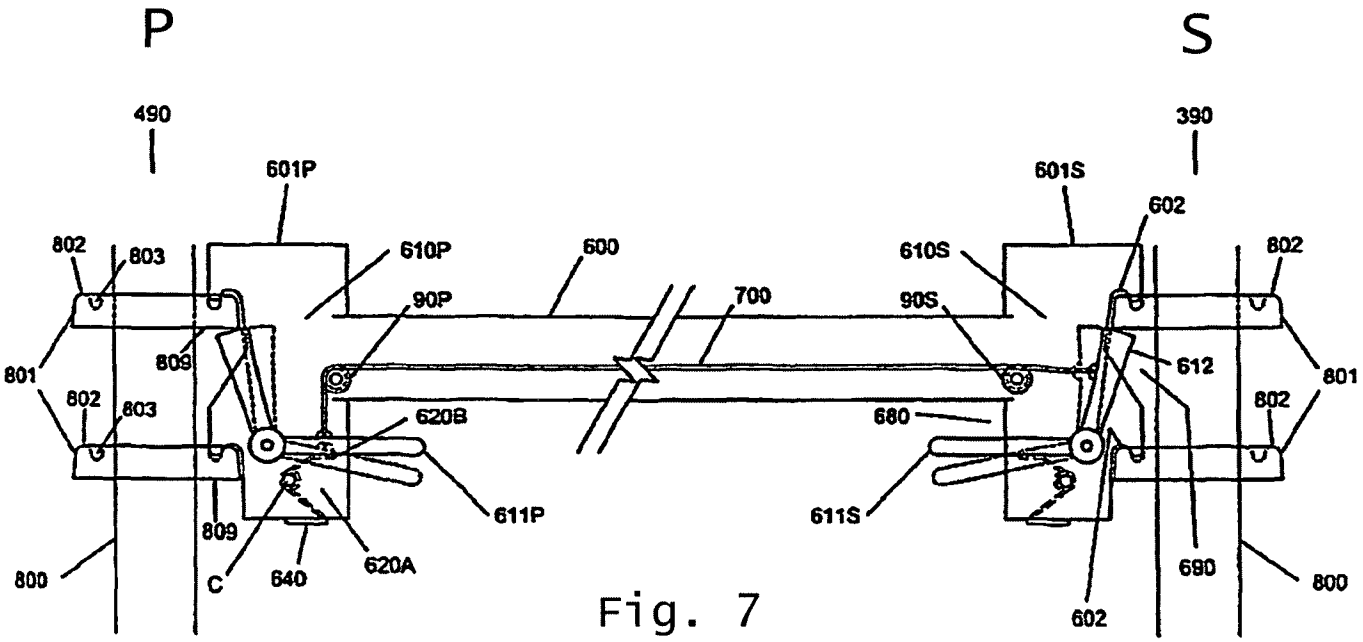
Fig. 7 Prior Art
FIG. 7 is a side partial cutaway view of one embodiment of the prior art dual latch invention in a Safway-type end connector.
Figure 8:
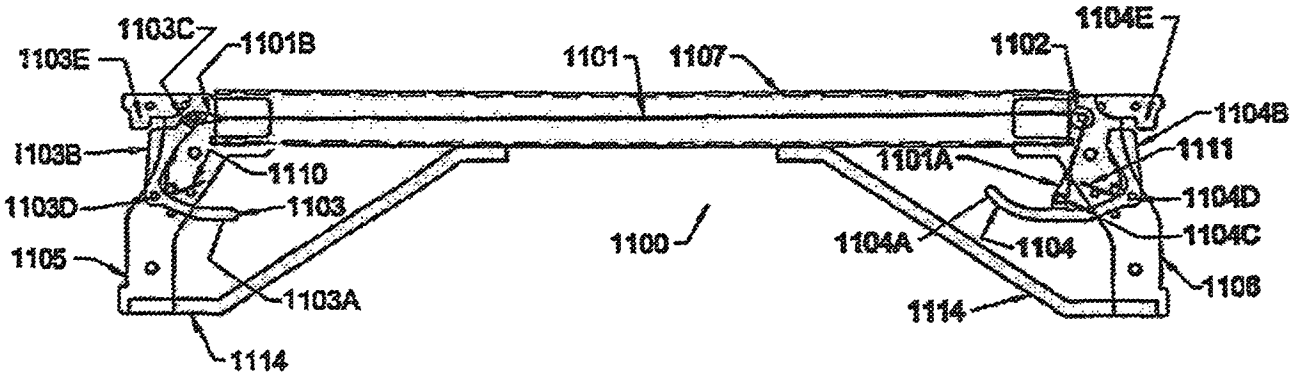
FIG. 8 Prior Art
FIG. 8 is a side, partial cutaway view of the prior art embodiment of the dual latching horizontal scaffold member in a latched or lock condition that is a modified pinlock system horizontal scaffold member.

Detailed embodiments of the present invention are disclosed herein. However, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Alternate embodiments may be devised without departing from the spirit or the scope of the invention. Further, the terms and phrases used herein are not intended to be limiting, but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward.

As used herein, the terms "a" or "an" are defined as one or more than one. The term "plurality," as used herein, is defined as two or more than two. The term "another," as used herein, is defined as at least a second or more. The terms "comprises," "comprising," or any other variation thereof are intended to cover a non-exclusive inclusion, such that a process, method, article, or apparatus that comprises a list of elements does not include only those elements, but may include other elements not expressly listed or inherent to such process, method, article, or apparatus. An element proceeded by "comprises . . . a" does not, without more constraints, preclude the existence of additional identical elements in the process, method, article, or apparatus that comprises the element. The terms "including," "having," or "featuring," as used herein, are defined as comprising (i.e., open language). The term "coupled," as used herein, is defined as connected, although not necessarily directly, and not necessarily mechanically. As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Relational terms such as first and second, upper and lower, top and bottom, right and left, and the like may be used solely to distinguish one entity or action from another entity or action without necessarily requiring or implying any actual such relationship or order between such entities or actions.

Referring to FIGS. 9-11, an embodiment of a horizontal scaffold member of the present invention featuring primary, secondary, and tertiary release triggers is shown. The primary end is labeled P and the secondary end is labeled S in the drawings. A modified pinlock-type of latching end connector is shown, with upper tooth 3800 and lower tooth 3800B, similar to the connectors depicted and described in U.S. Pat. Nos. 9,303,417 and 8,881,869 in that the horizontal scaffold member comprises a primary trigger 1104 mounted to the primary (P) end connector and a secondary (S) trigger 1103 mounted to the secondary end connector. However, the present invention advantageously features a third, or tertiary, trigger 3000.

Figures 9A, 9B:
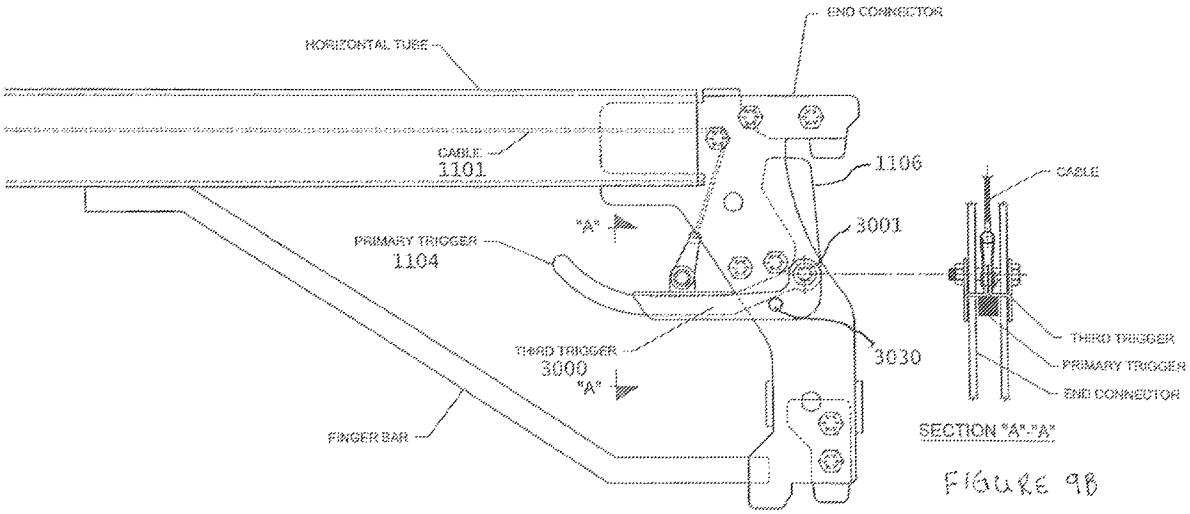
FIG. 9A is a side, partial cutaway view of one embodiment of the triple handled triple latching horizontal scaffold member depicting the primary ends primary and tertiary handles.
FIG. 9B is a cutaway view of the primary end connector end.

Still referring to FIGS. 9-11, the cable 1001 is rerouted from the secondary trigger 1103 through the horizontal member body, to the third or tertiary trigger 3000. The tertiary trigger 3000 is pivotally connected to the sidewall of the primary end connector 1106 at a pivot point 3001, preferably adjacent to the primary trigger 1104, as best shown in the cutaway view of FIG. 9A. As shown, the pivot point 3001 for the tertiary trigger 3000 is identical with the pivot point of the primary trigger 1104. Preferably, the primary trigger 1104 is positioned below the tertiary trigger and extends in front of—or away from—the tertiary trigger 3000, allowing an operator to grasp and actuate the primary trigger 1104 and leave the tertiary trigger 3000 in place and unactuated in one motion as shown in FIG. 11B. Alternatively, an operator, in a second motion, may grasp and rotate both triggers (i.e., handles) simultaneously as shown in FIG. 11C.

Figure 11A:
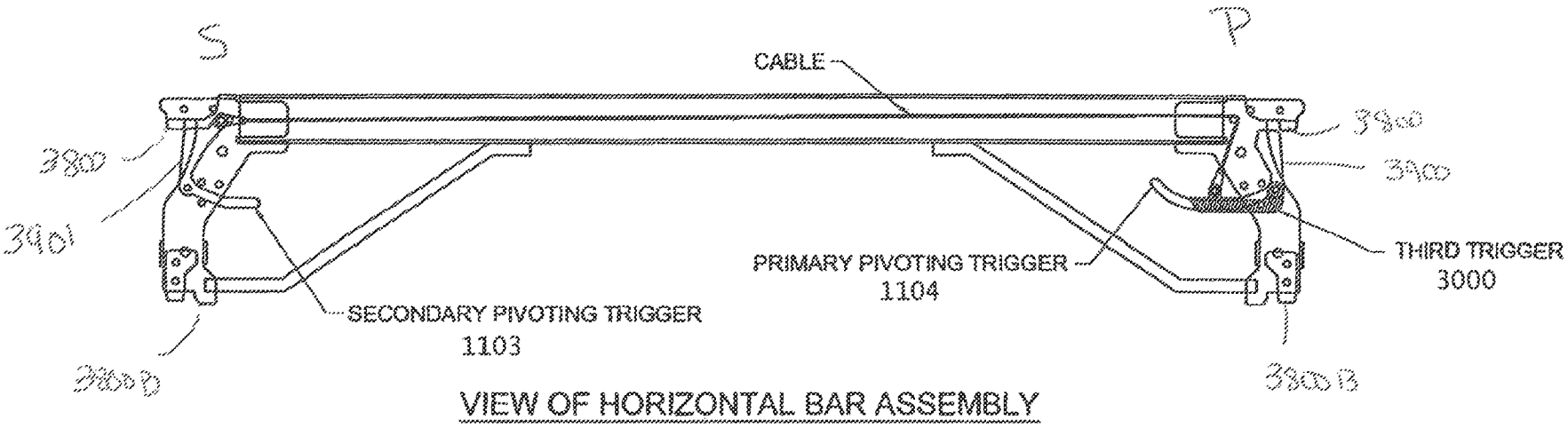
FIG. 11A is a side cutaway view of one embodiment of the invention with all handles unactuated, leaving the wedges in both wedge assemblies in a locked position, with the wedges rotated forwardly.
Figure 11B:
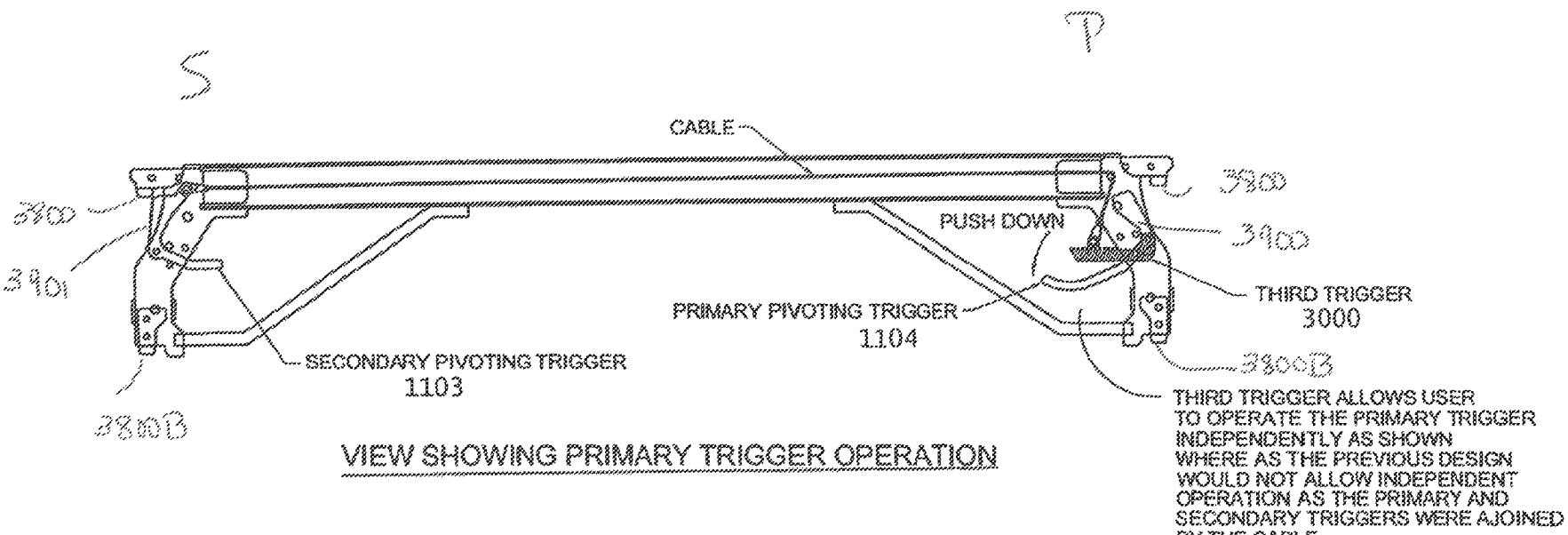
FIG. 11B is a side cutaway view of one embodiment of the invention, with only the primary handle actuated (rotated downwardly), rotating only the primary wedge inwardly, unlocking the primary wedge assembly only.
Figure 11C:
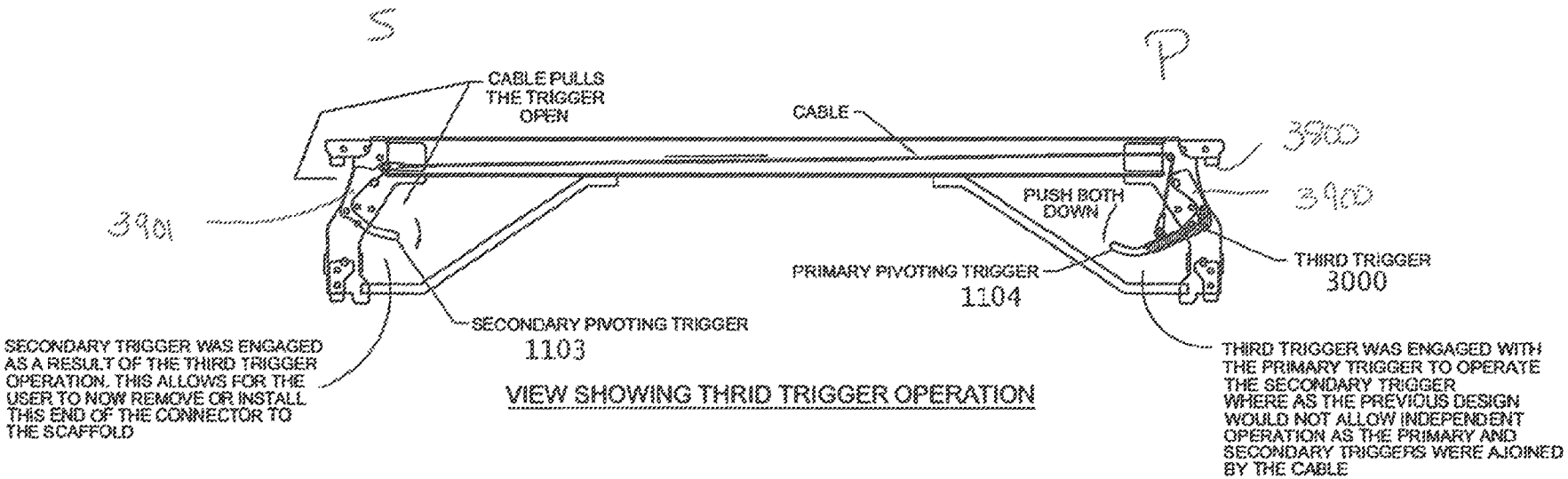
FIG. 11C is a side cutaway view of one embodiment of the invention, with both the primary and tertiary handles actuated (rotated downwardly), thereby rotating both the primary and secondary wedge inwardly, thereby unlocking both the primary and secondary sedge assembly.
Figure 11D:
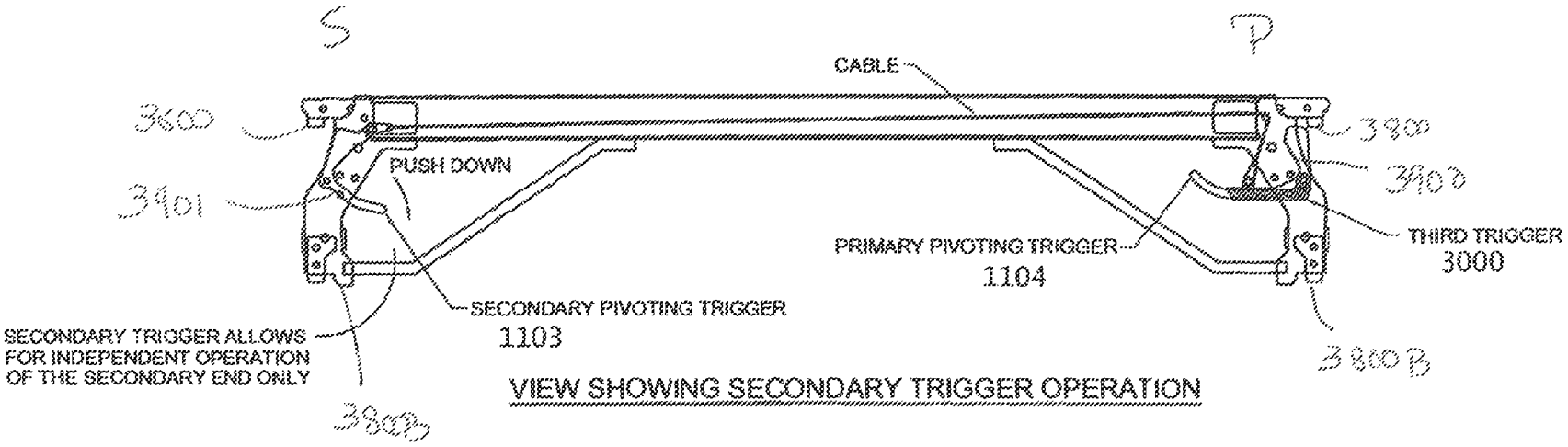
FIG. 11D is a side cutaway view of one embodiment of the invention with the secondary handle actuated (rotated downwardly), thereby rotating only the second wedge inwardly, thereby unlocking only the secondary wedge assembly.
Figure 12:
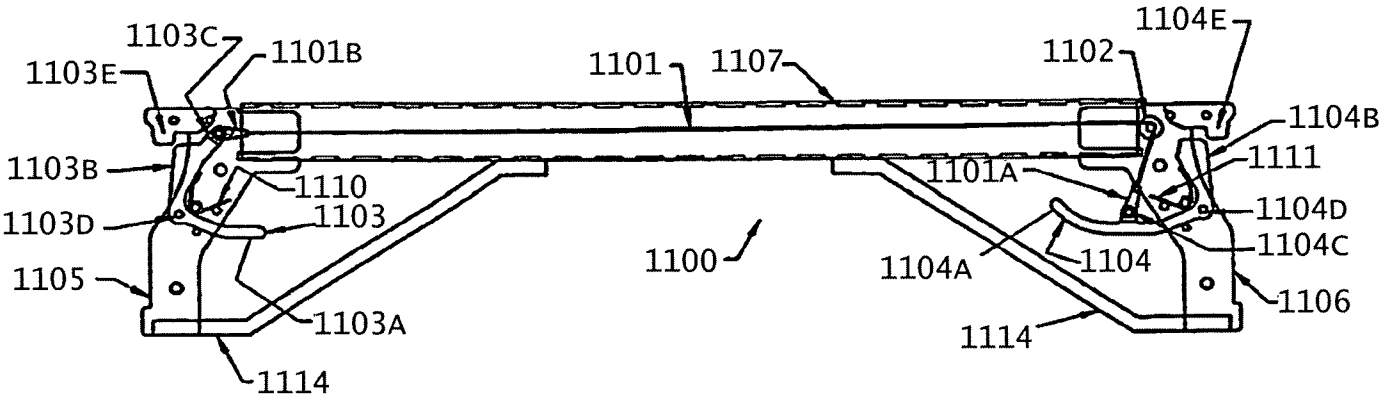
FIG. 12 Prior Art
FIG. 12 is a side partial cutaway view of another embodiment of the prior art dual latch invention in a rosette -type end connector

In one embodiment, the cable 1101 is pivotally attached to the tertiary trigger 3000 above the top of the trigger 3000 at a pivoting point 3003 (FIG. 9A). As shown in FIGS. 9A, 9B and 10, the tertiary trigger 3000 has a top portion 3010 and two sidewalls 3020. The top portion of the tertiary trigger preferably is positioned above the primary trigger 1104, while the two sidewalls 3020 of the tertiary trigger 3000 preferably extend around each side of the primary trigger 1104 such that a first sidewall 3020 is positioned adjacent to a first side of the primary trigger 1104 and a second sidewall 3020 is positioned adjacent to a second side of the primary trigger 1104 when the primary trigger is not actuated, that is, when the associated primary wedge 1104B is in the latched or locked position. The function of the primary trigger 1104 is to actuate only the primary wedge 1104B from a locked to an unlocked configuration, as shown in FIG. 11B. The combined trigger and wedge are referred to as the primary wedge assembly 3800 or secondary wedge assembly 3801 as shown. This is different from the prior dual action devices described in U.S. Pat. Nos. 9,303,417, or 8,881,869 where the primary handle or trigger also acted on the secondary wedge of the secondary end connector. Preferably, the primary trigger 1104 of the present invention is biased to the closed or unactuated position (locked) position as shown in FIG. 11A. When the horizontal scaffold member is connected to a vertical scaffold member and the primary trigger 1104 is unactuated or in the locked position, the primary wedge 1104B will be positioned below the rosette (or cup), thereby locking the primary end of the horizontal scaffold member to the vertical scaffold member. When the primary trigger 1104 is actuated (e.g. rotated downwardly) but the tertiary trigger 300 is not actuated, only the primary wedge 1104B will be brought to the unlatched position, thereby leaving the secondary wedge's position latched (see FIG. 11B). This is because the primary trigger 1104 is not connected to the cable. The actuation of the primary trigger alone has no impact on the secondary wedge assembly, and the secondary wedge 1103B will thus remain in the locked position. However, when both the primary and tertiary triggers are actuated (e.g., by being rotated downwardly as shown in FIG. 11C), both the primary wedge 1104B and secondary wedge 1103B will be brought to the unlatched position.

In operation, to release the primary end of the horizontal end connector from a vertical scaffold member, the primary trigger 1104 alone is grasped and rotated downwardly, thereby moving only the coupled wedge head assembly and wedge 1104B away for the rosette or cup, allowing removal of the primary end connector 1106 from the vertical scaffold member by exerting an upward force. In this instance, the secondary end of the horizontal scaffold member (containing the secondary trigger 1103) remains connected to an adjacent vertical scaffold member. However, if both the primary trigger 1104 and tertiary triggers 3000 are actuated together (pivoted downwardly), both the primary and secondary triggers, and the associated primary wedge 1104B and secondary wedge 1103B, are moved to an unlatched or unlocked configuration, allowing for complete removal of the horizontal scaffold member from the two adjacent vertical scaffold members, by application of an upward force.

Preferably, the tertiary trigger 3000 is colored differently (e.g., red) from the primary trigger to help an operator visually distinguish the tertiary trigger from the primary trigger. Additionally, the tertiary trigger may have a lock to keep the trigger from actuation. For instance, a flexible spring button may to located on the sidewall of the join to interact with an opening on the tertiary trigger, such as opening 3030 shown in FIG. 9, to keep the tertiary trigger locked unless thee button is depressed.

Other embodiments of the tertiary trigger are possible. For instance, the tertiary trigger 3000 may have be a single flat plate-like member connected to the cable, with the plate mounted above the primary trigger. Alternatively, a single plate tertiary trigger may be mounted adjacent to one side of the primary trigger, allowing the primary trigger to be actuated alone, the primary and tertiary triggers to be actuated simultaneously, or the tertiary trigger to be operated alone. To assist in a tertiary trigger alone operation, the single bar may have a hand or finger grip or ring attached thereto (not shown). Alternatively, the cable may end in a connector, such as a loop, or a spring snap link can be connected, or disconnected to a connector attached to the primary connector (like an eyebolt). In this embodiment, a tertiary trigger is not needed; to activate just the primary wedge assembly with the primary trigger, the cable is disconnected to the primary trigger before activation; to activate both wedge assemblies with the primary trigger, the cable is connected to the primary trigger before activation of the primary trigger.

In an embodiment of the invention, the design of the end connector at each end of each horizontal member keeps scaffold components square and rigid at all times utilizing predetermined angles via the grid design. The scaffold design of the invention reduces leading edge fall hazards associated with conventional scaffold systems. The scaffold design of the invention also reduces the need for hand tools during the installation and dismantling of horizontal members. Advantageously, the scaffold design of the invention reduces the amount of labor and time needed to install and dismantle a scaffold system.

The components of the invention can be fabricated from a variety of materials, including galvanized or powder coated steel, iron or other resilient material. The rosette preferably has a seven inch (7") diameter, and the internal first and second rods can comprise two square, or cylindrical rods, made of e.g., steel or iron, each having a wedge portion added or integrated at an end, the opposite ends being coupled to the crank/cam assembly. Using the grid pattern of apertures on the rosette and head having prongs dimensioned to fit therein, various angles between the horizontal members can be obtained (e.g., 45, 90, 180 degrees) for the elevated working platform.

Advantageously, the invention allows the erector to engage and disengage both wedge portions of a single horizontal member from a single point reducing installation time and creating a safer work environment. This is because the primary and tertiary triggers, may be simultaneously activated by a single operator, to engage and disengage each wedge substantially simultaneously. In this manner, up to eight (8) horizontal members can be attached to a single vertical member by a single installer without changing his position.

The invention further comprises a grid of components that mesh together creating rigid angled connection among a plurality of horizontal members at a vertical member. Both of the wedges which are part of a wedge assembly, are locked into position at the rosette on a vertical member from a single position. The internal wedge portions are locked into place by an external handle eliminating the use of any hand tools. The external handle can also be locked into place creating a secondary locking device.

The embodiments shown and described above are only exemplary. Even though numerous characteristics and advantages of embodiments of the invention have been set forth in the foregoing description together with details of the invention, the disclosure is illustrative only and changes may be made within the principles of the invention to the full extent indicated by the broad general meaning of the terms used herein. For example, the concepts described herein for coupling horizontal members to vertical members can be used to couple bracing members to vertical members or to horizontal members. Coupling includes, but is not limited to attaching, engaging, mounting, clamping, welding, bolting and components used for coupling include bolts and nuts, rivets, clevis, latches, clamps, welds, screws, rivets and the like. Further, a rosette having eight (8) radially arranged cut-outs is described herein for illustrative purposes and a rosette having more or less radially arranged cut-outs is considered to be within the scope of this invention. Also, the invention describes a rosette having a standard diameter of about seven (7) inches, however, any suitable diameter can be used. The use of a wedge head with a pair, or a wedge head with two pair, of vertical prongs is described herein for illustrative purposes and a wedge head having one or more prongs is considered within the scope of this invention. The rosette can include any suitable cut-out shape that is dimensioned to receive a corresponding prong or set of prongs of a wedge head. The vertical member can have any number of coaxially aligned rosettes attached thereto, the vertical spacing of such rosettes being any such distance as is suitable for the intended use. More generally, the invention is a scaffold system with a horizontal member, a vertical member with at least one rosette affixed in coaxial alignment to the vertical member and a wedge assembly within the horizontal member, portions of the wedge assembly for locking the horizontal member to the rosette. The vertical member has a plurality of evenly spaced rosettes affixed in coaxial alignment along the vertical member and at least one rosette has a pattern or grid of apertures designed to receive the end of the horizontal member.

To those skilled in the art to which this invention relates, many changes in construction and widely differing embodiments and applications of the invention will suggest themselves without departing from the scope of the invention as defined herein and in the appended claims. The disclosures and the descriptions herein are purely illustrative and are not intended to be in any sense limiting. The embodiments shown and described above are only exemplary. Even though numerous characteristics and advantages of embodiments of the invention have been set forth in the foregoing description together with details of the invention, the disclosure is illustrative only and changes may be made within the principles of the invention to the full extent indicated by the broad general meaning of the terms used herein. For example, the concepts described herein for coupling horizontal members to vertical members can be used to couple bracing members to vertical members or to horizontal members. Coupling includes, but is not limited to attaching, engaging, mounting, clamping, welding, bolting and components used for coupling include bolts and nuts, rivets, clevis, latches, clamps, welds, screws, rivets and the like. The vertical member can have any number of coaxially cups attached thereto, the vertical spacing of such cups being any such distance as is suitable for the intended use. The method includes a method of disconnecting both ends of a horizontal scaffold member from a vertical scaffold member.

The invention claimed is:

1. A horizontal scaffold member comprising:

a member and a primary wedge head attached to one end of the member and a secondary wedge head attached to an opposite end of the member, said primary and secondary wedge heads each having a downwardly projecting tooth or hook portion configured to couple to an annular member on a vertical scaffold member, said primary and secondary wedge heads further comprising a respective primary wedge assembly and secondary wedge assembly, said wedge assemblies comprising a respective primary and secondary wedge and a respective primary and secondary handle partially positioned within each respective wedge head, each said wedge assembly movable in said respective wedge head from a latched to an unlatched position by an operator moving the respective handle from the latched to the unlatched position, whereby in said respective latched position, said respective wedge is positioned adjacent said tooth or hook portion of said respective wedge head, and in said unlatched position, said respective wedge is positioned distal from said respective tooth or hook portion of said respective wedge head;

a tertiary handle located on said primary wedge head, said tertiary handle configured to move from a latched to an unlatched position by the operator, a cable connecting said tertiary handle to said secondary wedge assembly;

wherein when said tertiary handle is in the latched position, said secondary wedge assembly may be in the latched or unlatched position, and when said tertiary handle is in the unlatched position, said secondary wedge assembly is in said unlatched position;

said tertiary handle positioned on said primary wedge head so the operator can simultaneously move both tertiary and primary handles form a latched to an unlatched position.

2. The horizontal scaffold member of claim 1 wherein each of said wedge assemblies are separately biased to said respective latched positions.

3. The horizontal scaffold member according to claim 2 wherein each of said wedge assemblies further comprises a spring member that biases each respective said wedge assembly to their latched position.

4. The horizontal scaffold member according to claim 1 wherein each of said wedge assemblies are pivotable in said respective wedge head.

5. The horizontal member of claim 1 wherein said hook portion is configured to couple with the annular member wherein the annular member further comprises an upstanding annular cup.

6. The horizontal member of claim 1 wherein said tooth is configured to couple with openings on the annular member wherein the annular member further comprises a rosette annular member.

7. The horizontal scaffold member according to claim 1 further comprising a rotatable member mounted in said primary wedge head and said cable sliding on said rotatable member when said tertiary handle is moved from the latched to unlatched position.

8. The horizontal scaffold member according to claim 1 wherein each of said wedge heads further comprises a second tooth or second hook portion coupleable with a second annular member on said associated vertical scaffold member.

9. The horizontal scaffold member according to claim 8, wherein said tertiary handle is a contrasting color from said primary handle, to allow an operator to visually distinguish between the primary and tertiary handles.

10. The horizontal scaffold member of claim 8 wherein said cable is a wire rope.

11. The horizontal scaffold member according to claim 1 wherein said cable is attached to said secondary wedge assembly at said wedge of said secondary wedge assembly, and wherein said cable is attached to said tertiary handle.

12. A horizontal scaffold member comprising:

a) a horizontal pipe;

b) a primary end connector attached to a first end of the horizontal pipe, the primary end connector comprising: (i) a primary connector frame; (ii) an engagement portion proj ecting downwardly from a top portion of the primary connector frame, the engagement portion being configured to engage a top portion of an annular member of a first vertical scaffold member; (iii) a primary wedge assembly pivotally attached to the primary connector frame, the primary wedge assembly comprising a primary wedge and a primary trigger, the primary trigger being movable between an actuated position and an unactuated position, the primary wedge being configured to releasably engage a bottom portion of the annular memberof the first vertical scaffold member when the primary trigger is unactuated, and to disengage from the bottom portion when the primary trigger is actuated; and; (iv) a tertiary trigger positioned adjacent to the primary wedge assembly, said tertiary trigger movable between an actuated position and an unactuated position;

c) a secondary end connector attached to a second end of the horizontal pipe, the secondary end connector comprising: (i) a secondary connector frame; (ii) an engagement portion projecting downwardly from a top portion of the secondary connector frame, the engagement portion being configured to engage a top portion of an annular member of a second vertical scaffold member; (iii) a secondary wedge assembly pivotally attached to the secondary connector frame, the secondary wedge assembly comprising a secondary wedge and a secondary trigger, and the secondary trigger being movable between an actuated position and an unactuated position, and in the unactuated position the secondary wedge being configured to releasably engage a bottom portion of the annular member of the second vertical scaffold member, and in the actuated position the secondary wedge being configured to disengage the bottom portion of the annular member of the second vertical scaffold member; and wherein when said tertiary trigger is in the actuated position, said secondary wedge assembly may be in the actuated or unactuated position, and when said tertiary trigger is in the unactuated position, said secondary wedge assembly is in said unactuated position of the secondary wedge assembly; said tertiary trigger positioned on said primary wedge head so the operator can simultaneously move both tertiary and primary handles form respective actuated to an unactuated position d) a cable connecting the tertiary trigger to the secondary wedge assembly.

13. The horizontal scaffold member of claim 12, wherein the actuated position of the secondary, and tertiary triggers defines the disengaged position of the secondary wedge, and wherein the unactuated position of the secondary trigger defines the engaged position of the secondary wedge and when the tertiary trigger is in the unactuated position, the secondary wedge may be in either the engaged or disengaged position.

14. The horizontal scaffold member of claim 13, wherein the primary, secondary, and tertiary triggers are biased into the respective unactuated position by springs.

* * * * *